US008678606B2

(12) United States Patent
Berger

(10) Patent No.: US 8,678,606 B2
(45) Date of Patent: Mar. 25, 2014

(54) CARRYING CONTAINER WITH AT LEAST TWO LIGHT SOURCES

(75) Inventor: Aja A. Berger, Naples, FL (US)

(73) Assignee: Aja Berger, Naples, FL (US)

( * ) Notice: Subject to any disclaimer, the term of this patent is extended or adjusted under 35 U.S.C. 154(b) by 152 days.

(21) Appl. No.: 12/940,537

(22) Filed: Nov. 5, 2010

(65) Prior Publication Data

US 2011/0305008 A1 Dec. 15, 2011

Related U.S. Application Data

(60) Provisional application No. 61/354,357, filed on Jun. 14, 2010.

(51) Int. Cl.
*A45C 15/06* (2006.01)

(52) U.S. Cl.
USPC ..... 362/156; 362/154; 362/184; 362/249.01; 362/249.12; 362/249.13; 200/61.41

(58) Field of Classification Search
USPC ..... 362/154, 155, 156, 184, 205, 206, 362/249.01, 249.02, 249.05, 249.12, 362/249.13, 800, 802, 183; 200/61.19, 200/61.41
See application file for complete search history.

(56) References Cited

U.S. PATENT DOCUMENTS

| | | | | |
|---|---|---|---|---|
| 702,403 | A * | 6/1902 | Chapman | 362/156 |
| 1,183,268 | A * | 5/1916 | Baldwin et al. | 362/156 |
| 1,531,288 | A * | 3/1925 | Johnston | 362/156 |
| 2,276,370 | A * | 3/1942 | Conrad | 362/156 |
| 2,554,603 | A | 5/1951 | Terlinde | |
| 2,565,895 | A * | 8/1951 | Wadland | 362/155 |
| 2,647,201 | A | 7/1953 | Contento | |
| 2,802,074 | A * | 8/1957 | Pass | 200/61.19 |
| 2,827,559 | A | 3/1958 | Hoffman | |
| 2,880,306 | A * | 3/1959 | Witte | 362/183 |
| 2,982,849 | A * | 5/1961 | Volkerling et al. | 362/183 |
| 3,109,132 | A * | 10/1963 | Witte | 320/114 |
| 3,239,658 | A * | 3/1966 | Castaldo | 362/155 |
| 3,404,267 | A * | 10/1968 | Zucker | 362/156 |
| 3,408,489 | A | 10/1968 | Boyer | |
| 3,609,341 | A | 9/1971 | Castaldo | |
| 3,609,342 | A | 9/1971 | Wisniewski | |
| 3,800,134 | A | 3/1974 | Castaldo | |
| 3,808,416 | A | 4/1974 | Pottratz | |
| 3,976,871 | A | 8/1976 | Atherton | |
| 4,015,112 | A | 3/1977 | Castaldo | |

(Continued)

FOREIGN PATENT DOCUMENTS

| | | |
|---|---|---|
| DE | 20200600174 | 3/2006 |
| WO | WO2007123575 | 1/2007 |
| WO | WO2007087843 | 8/2007 |

OTHER PUBLICATIONS

Purse Bright; As seen on TV; web pages (3); asseenontvguys.com/index.asp?PageAction=VIEWPROD&ProdID=89.

(Continued)

*Primary Examiner* — Ismael Negron

(57) ABSTRACT

A lighting system includes a carrying container; at least two light sources to illuminate the interior and exterior of a the carrying container, each light source operatively connected directly to an actuation sensing device and to a power source. Magnetic actuators, mounted onto the carrying container activate each light source to provide illumination and independent of the access state of the carrying container.

9 Claims, 8 Drawing Sheets

(56) References Cited

U.S. PATENT DOCUMENTS

| | | | | | |
|---|---|---|---|---|---|
| D265,132 | S | | 6/1982 | Brooks | |
| 4,376,935 | A | | 3/1983 | Castaldo | |
| 4,425,600 | A | * | 1/1984 | Barnhart | 362/249.12 |
| 4,517,627 | A | | 5/1985 | Bradford | |
| 4,654,763 | A | | 3/1987 | Knight | |
| 4,972,304 | A | | 11/1990 | Ylla | |
| D315,830 | S | | 4/1991 | Roberts | |
| 5,005,111 | A | | 4/1991 | Teal | |
| 5,018,057 | A | | 5/1991 | Biggs et al. | |
| 5,057,824 | A | * | 10/1991 | Stokes | 455/127.1 |
| 5,067,063 | A | * | 11/1991 | Granneman et al. | 362/156 |
| 5,073,844 | A | | 12/1991 | Coyner | |
| 5,245,517 | A | * | 9/1993 | Fenton | 362/156 |
| 5,268,827 | A | | 12/1993 | Granneman | |
| 5,424,926 | A | | 6/1995 | Myers | |
| 6,120,162 | A | | 9/2000 | Guerrieri | |
| 6,152,572 | A | | 11/2000 | Cutler | |
| 6,340,235 | B1 | | 1/2002 | Bryan | |
| 6,447,142 | B1 | | 9/2002 | Weir | |
| 6,499,857 | B1 | | 12/2002 | Lumley | |
| 6,502,951 | B2 | | 1/2003 | Marshall | |
| 6,824,291 | B2 | * | 11/2004 | Vautrin et al. | 362/156 |
| 6,848,808 | B2 | | 2/2005 | Guerrieri | |
| 7,033,040 | B2 | * | 4/2006 | Spahr et al. | 362/155 |
| 7,063,437 | B2 | * | 6/2006 | Taddeo et al. | 362/156 |
| 7,111,959 | B2 | * | 9/2006 | Kurcz et al. | 362/156 |
| 7,178,936 | B2 | | 2/2007 | Lai | |
| 7,220,016 | B2 | * | 5/2007 | Matthews et al. | 362/249.13 |
| 7,281,815 | B1 | * | 10/2007 | Gustafson et al. | 362/206 |
| 7,347,235 | B2 | | 3/2008 | Beverly | |
| 7,410,270 | B2 | | 8/2008 | Long et al. | |
| 7,527,388 | B2 | * | 5/2009 | Kim | 362/205 |
| 7,722,204 | B1 | | 5/2010 | Sandberg | |
| 2002/0067610 | A1 | | 6/2002 | Marshall | |
| 2003/0086256 | A1 | | 5/2003 | Ip | |
| 2003/0090895 | A1 | | 5/2003 | Guerrieri | |
| 2004/0141314 | A1 | | 7/2004 | Vautrin et al. | |
| 2005/0174758 | A1 | | 8/2005 | Fields | |
| 2005/0219839 | A1 | | 10/2005 | Branson | |
| 2005/0231937 | A1 | | 10/2005 | Fitzgerald | |
| 2006/0096680 | A1 | | 5/2006 | Khubani | |
| 2007/0008714 | A1 | | 1/2007 | Kilfedder | |
| 2007/0183141 | A1 | | 8/2007 | Popov | |
| 2007/0279918 | A1 | | 12/2007 | Francis | |
| 2008/0037242 | A1 | | 2/2008 | Long | |

OTHER PUBLICATIONS

Crystal Handbag Light Is Useful Shaped Bling; Chip chic; web pages (7); ChipChick.com/2009/01/crystal_hand_bag_light.html.

Pursepal Handbag Lights; coolest gadgets; webpages (9); coolest-gagets.com/20060313/pursepal-handbag-lights/.

Magnetic Handbag Light; Hollywoodlighting by Slick Ideas, Inc.; web pages (2); hollywoodlighting.com; c. 2009.

Smartlyte; Smart LED Lighting System LightMyBag.com; webpages (1); c. 2008.

* cited by examiner

CARRYING CONTAINER WITH AT LEAST TWO LIGHT SOURCES

PRIORITY INFORMATION

The present application claims priority, under 35 U.S.C. §119(e), from U.S. Provisional Patent Application Ser. No. 61/354,357, filed on Jun. 14, 2010. The entire content of U.S. Provisional Patent Application Ser. No. 61/354,357, filed on Jun. 14, 2010, is hereby incorporated by reference.

BACKGROUND

Carrying containers are made of flexible or rigid materials and come in a variety of shapes, sizes, and descriptions for serving a wide variety of purposes. The term "carrying container" as used herein, refers generally to but is not limited to luggage, suitcases, briefcases, attaché or sample cases, backpacks, handbags, sample cases, pocketbooks, shoulder bags, diaper bags, and/or purses.

With advances in technology, portable electronic devices such as phones, tablets and laptops have become prevalent in daily use. These are carried along with personal items such as makeup, wallets, pens, documents, money, credit cards, and keys, both in personal and professional carrying containers.

Though convenient and often indispensable, the electronic devices together with personal items carried can comprise a significant weight. Thus the weight of the carrying container itself is of importance to users of such carrying containers.

Therefore, components added to a carrying container as integral parts of such a container, must be as lightweight as possible.

The increase in the variety of items carried has served to increase the difficulty faced by users of carrying containers in attempting to locate any particular item within the interior of a carrying container. Moreover, the access opening of a carrying container is not sufficiently large to enable an adequate amount of ambient light to illuminate the objects randomly dispersed within the carrying container.

Thus, even when the carrying container is in the wide open position, the light directed into the interior of the carrying container is usually insufficient to illuminate the items piled upon each other inside the carrying container, particularly when the surrounding available light is substantially diminished due to the absence of sun or artificial light.

Therefore, finding a desired article may require the user to open the carrying container and blindly shuffle through the contents until the form of the desired item is felt. Given this lack of visual acuity, a significant time delay may be encountered when attempting to identify and retrieve an object, which in some circumstances may present a significant concern relative to safety.

Conventionally, the lack of illumination has been addressed by adding a single light source inside a carrying container.

Examples of these conventional devices are set forth in U.S. Pat. No. 7,178,936; U.S. Pat. No. 7,111,959; U.S. Pat. No. 6,848,808; U.S. Pat. No. 6,824,291; U.S. Pat. No. 6,447,142; U.S. Pat. No. 6,120,162; U.S. Pat. No. 5,018,057; and U.S. Pat. No. 3,239,658. The entire contents of U.S. Pat. No. 7,178,936; U.S. Pat. No. 7,111,959; U.S. Pat. No. 6,848,808; U.S. Pat. No. 6,824,291; U.S. Pat. No. 6,447,142; U.S. Pat. No. 6,120,162; U.S. Pat. No. 5,018,057; and U.S. Pat. No. 3,239,658 are hereby incorporated by reference.

Such conventional devices which do provide for multiple light sources within a single lighting system built into a carrying container and activated by magnetic actuators, require the number of such magnetic actuators to equal the number of light sources to operatively engage the light sources, since each magnetic actuator is physically attached to the carrying container in a manner which limits its reach to one specific actuation sensing device.

Therefore, a lighting system coupled to such a container, whereby all magnetic actuators are removable from the carrying container, allowing for a single actuator to activate all light sources in the lighting system, would be advantageous as the overall weight of the carrying container would be reduced.

Moreover, a lighting system wherein all components can be optionally substituted to ones best suited to a given user or application, would be desirable. Such substitution could include the use of highly sensitive actuation sensing devices or magnetic sensors requiring low strength magnetic actuators to operate, or employing light sources such as light emitting diodes, electroluminescent flexible panels or other low power light sources.

In addition, in instances where the application of the carrying container is such that multiple magnetic actuators would not present a danger to the user, a lighting system allowing for such magnetic actuators to optionally be mounted to the carrying container by means of a switch, would allow greater adaptability of the system to such an application.

The flexibility of the above described lighting system allows it to be coupled to other items for illuminating areas where lighting is desired or necessary and can provide safety illumination for the purpose of avoiding a situation in which the lack of illumination could bring harm to the user.

SUMMARY OF INVENTION

A lighting system with one or multiple light sources interiorly or exteriorly of the carrying container, activated easily, quickly and at will, independently of the open state of the carrying container or the act of opening the carrying container.

A lighting system which allows for the activation of each light source within the system individually, thereby preventing the unnecessary discharge of the power source which can be a rechargeable or non-rechargeable battery.

A lighting system comprised of components which are lightweight and inexpensive, require no special tools or skills to assemble, substitute or replace, and add minimal weight and cost to the overall weight and cost of the carrying container.

A lighting system wherein all magnetic actuators are removable from the carrying container, preventing the circuit from being closed inadvertently and discharging the power source.

A lighting system wherein the device for placing and maintaining a magnetic actuator in operative proximity to an actuation sensing device, can be affixed to any location on the carrying container appropriate to the containers design or application, this location limited only by the strength of the magnetic field generated by the magnetic actuator relative to the corresponding actuation sensing device, to activate the light source operatively connected to that actuation sensing device.

BRIEF DESCRIPTION OF DRAWINGS

The drawings are only for purposes of illustrating various embodiments and are not to be construed as limiting, wherein.

DETAILED DESCRIPTION OF DRAWINGS

Figure 1:
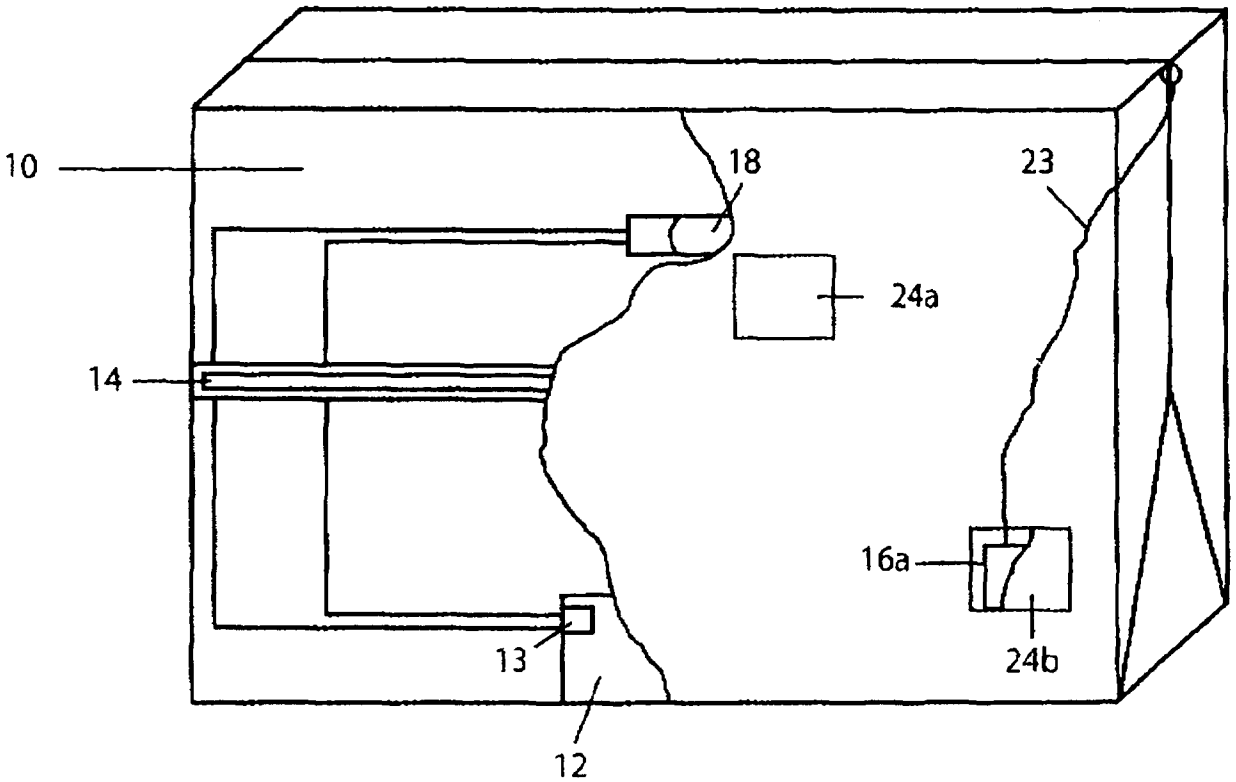
FIG. 1 is a front view of an embodiment of a carrying container in a closed state, showing a non-activated interior light source, an actuation sensing device, a set of two magnetic actuator holding devices in the form of pockets attached to the exterior of a carrying container, a tethered magnetic actuator in a pocket which places it in non-operative proximity to an actuation sensing device, and a power source with an interface.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

A carrying container may have two access states, open or close, wherein the open access state allows a user to access the contents within the carrying container, and the closed access state precludes the user from accessing the contents within the carrying container. The lighting system functions irrespective of the access state of the carrying container.

FIG. 1 is an illustration of a closed carrying container 10, including a power source 12 with an interface 13, an interior light source 14, a set of two actuator holding devices in the form of pockets 24*a* and 24*b*, magnetic actuator 16*a*, attached to carrying container 10 with tether 23, and an actuation sensing device 18, affixed to carrying container 10.

The combination of power source 12, light source 14, and magnetic actuator 16 forms an electrical circuit which is normally open when magnetic actuator 16 is not in proximity to operatively engage actuation sensing device 18. The wiring between the components of the circuit is shown.

Interior light source 14 does not provide any illumination because, as illustrated in FIG. 1, magnetic actuator 16*a* is placed in actuator pocket 24*b*, thereby being in non-operative proximity to actuation sensing device 18.

Figure 2:
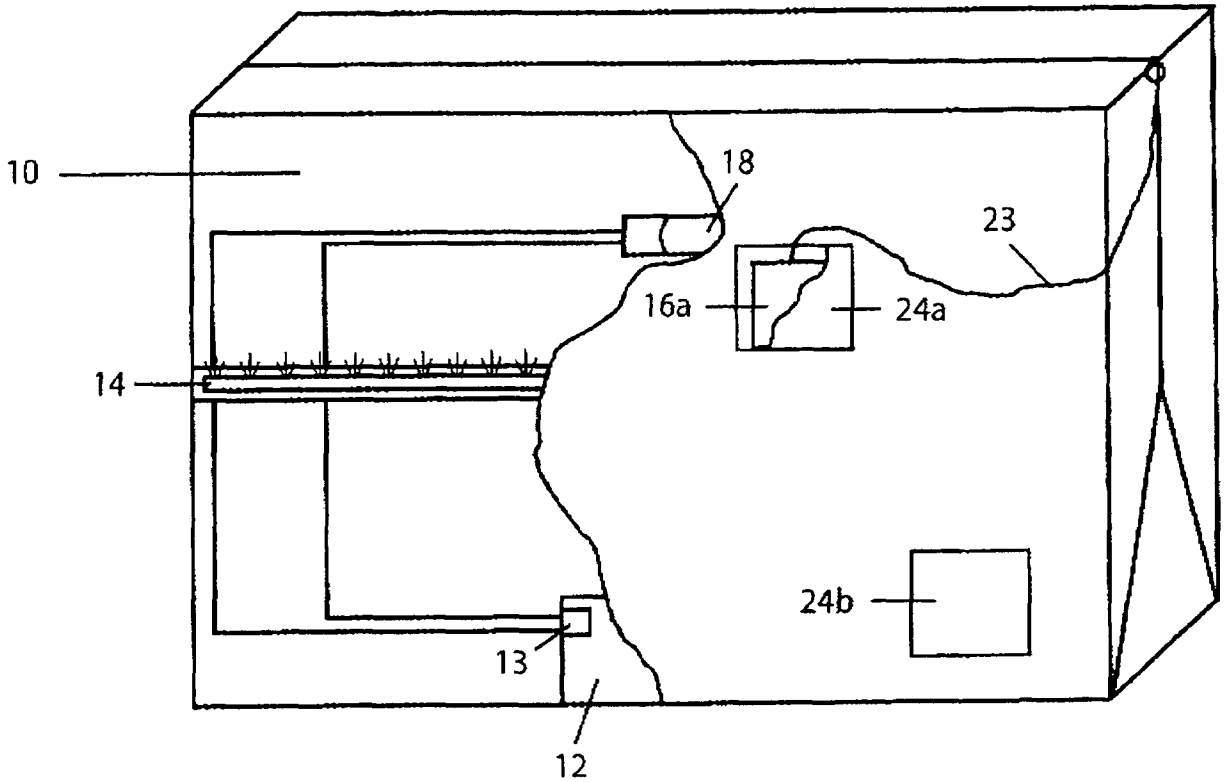
FIG. 2 is the embodiment of FIG. 1 showing an activated interior light source, an actuation sensing device, two pockets for a magnetic actuator, a tethered magnetic actuator in a pocket which places it in operative proximity to an actuation sensing device, and a power source with an interface.

To provide illumination, as illustrated in FIG. 2, magnetic actuator 16*a*, exteriorly attached to the carrying container 10 by tether 23, is maintained in operative engagement with actuation sensing device 18, affixed to carrying container 10, by being placed in actuator pocket 24*a* exteriorly affixed to a carrying container, thereby causing the circuit formed by power source 12, light source 14, actuation sensing device 18 and magnetic actuator 16*a*, to become a closed circuit, allowing power to flow from power source 12 to interior light source 14.

Figure 3:
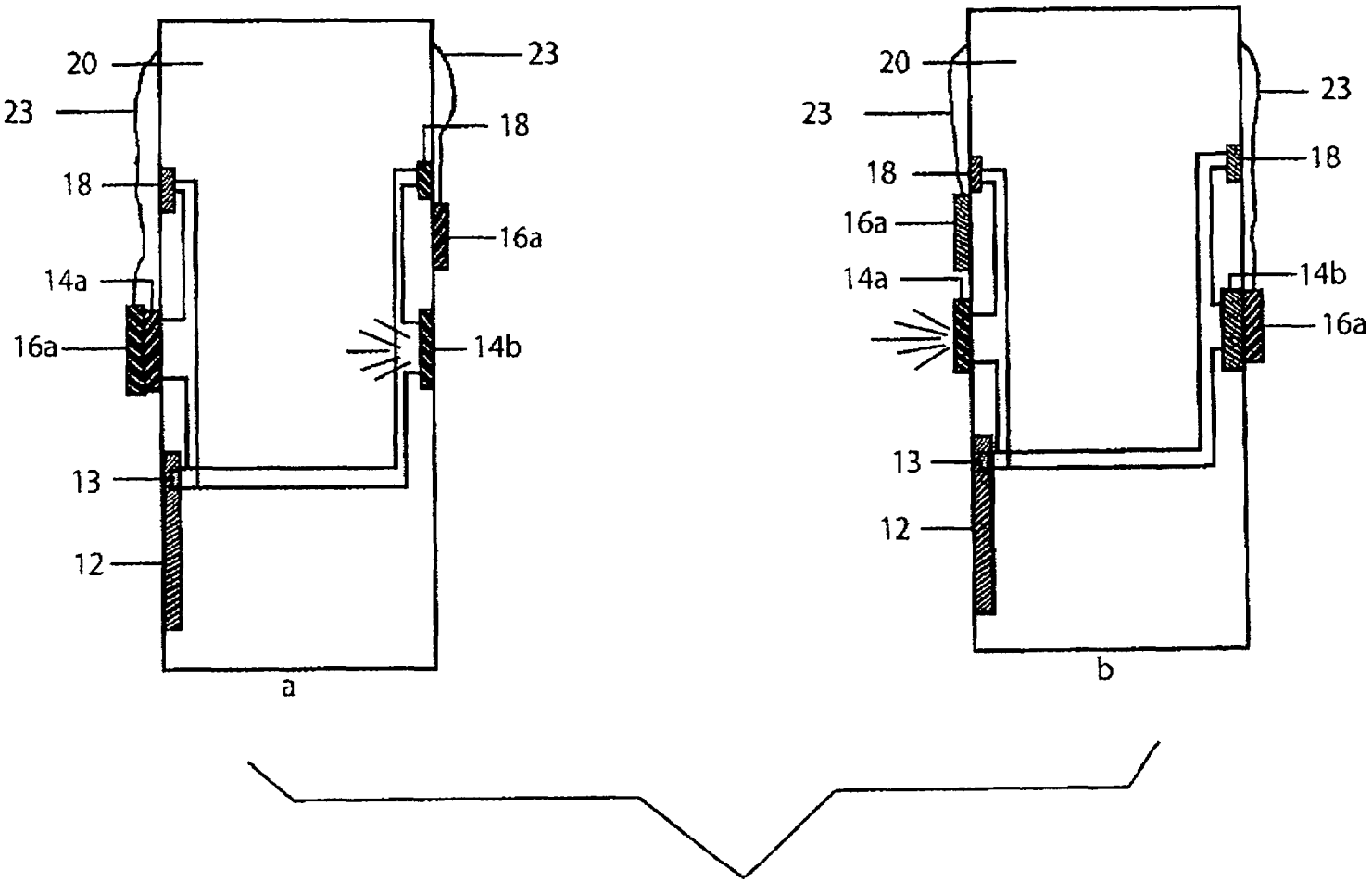
FIGS. 3*a* and 3*b* is a a profile view of an embodiment of a carrying container with two light sources to illuminate the interior space and the exterior of a carrying container; each light source having an actuation sensing device operatively connected to a single power source; each light source within and without the carrying container being activated by a tethered magnetic actuator. Holding device for magnetic actuators not shown.

Illustrated in FIGS. 3*a* and 3*b*, is a carrying container 20 wherein the interior space and the exterior of the carrying container each have a separate light source 14 and an actuation sensing device 18, both operatively connected directly to a power source 12 with interface 13. Magnetic actuators 16*a* are tethered to carrying container 20 by tether 23.

In FIG. 3*a*, exterior light source 14*a* of a carrying container 20 is de-activated (turned OFF) by tethered magnetic actuator 16*a* being in non-operative proximity to actuation sensing devices 18, while interior light source 14*b* is activated (turned ON) by tethered magnetic actuator 16*a* being in operative proximity to actuation sensing device 18.

As shown in FIG. 3*b*, exterior light source 14*a* of a carrying container 20 is activated (turned ON) by tethered magnetic actuator 16*a* being in operative proximity to actuation sensing devices 18, while interior light source 14*b* is de-activated (turned OFF) by tethered magnetic actuator 16*a* being in non-operative proximity to actuation sensing device 18.

Figure 4:
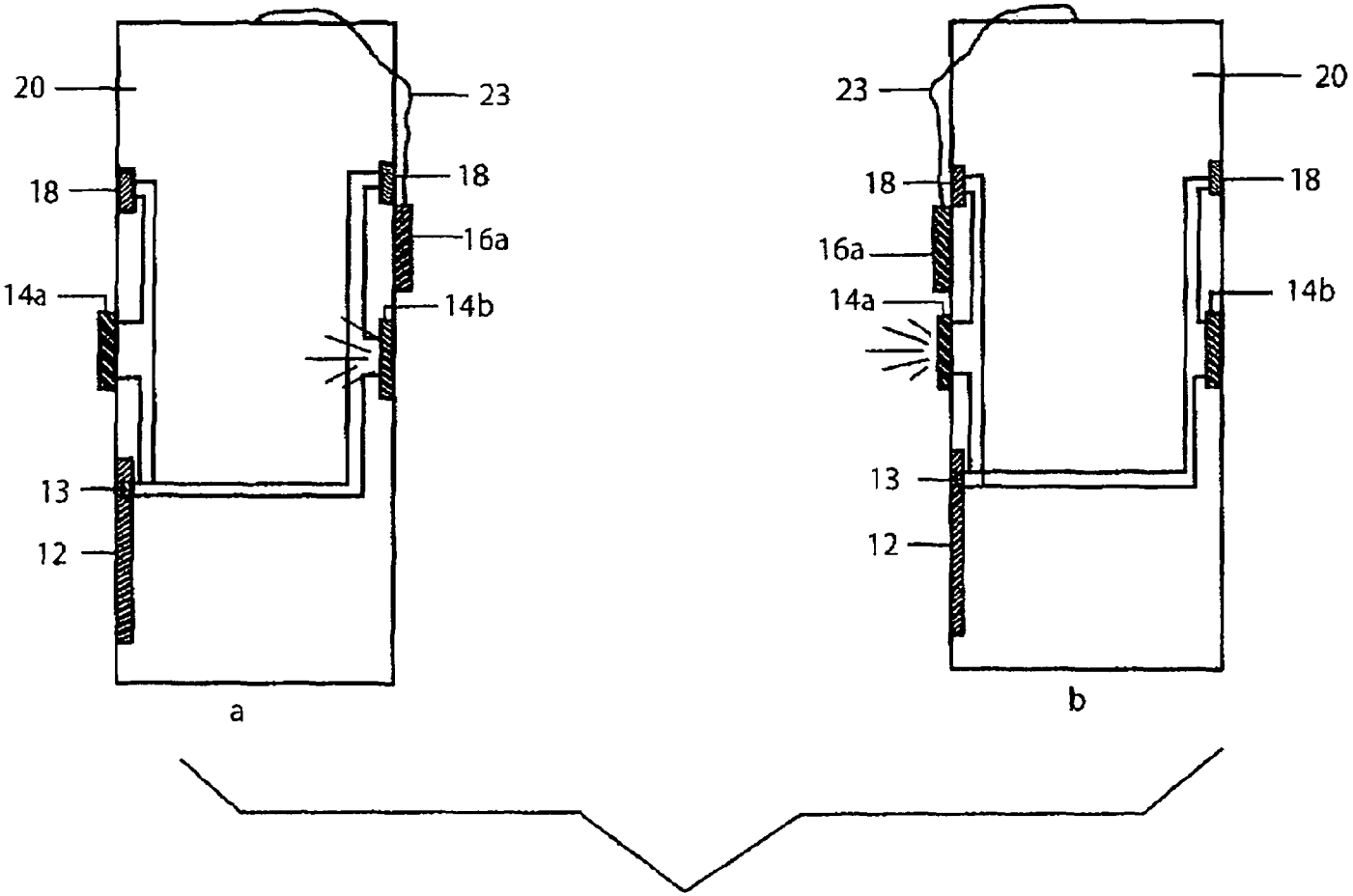
FIGS. 4*a* and 4*b* is a profile view of an embodiment of a carrying container with two light sources to illuminate the interior space and the exterior of a carrying container; each light source having an actuation sensing device operatively connected to a single power source; both light sources within and without the carrying container being activated by a single tethered magnetic actuator. Holding device for magnetic actuator not shown.

Illustrated in FIGS. 4*a* and 4*b*, is a carrying container 20 wherein the interior space and the exterior of a carrying container have a separate light source 14 and actuation sensing device 18, operatively connected directly to power source 12 with interface 13; both interior and exterior light sources 14 within the carrying container 20 are activated by a single magnetic actuator 16*a* on tether 23. Holding device for magnetic actuator not shown.

In FIG. 4*a*, exterior light source 14*a* of carrying container 20 is de-activated (turned OFF) by the absence of tethered magnetic actuator 16 on tether 23, whereas interior light source 14*b* of carrying container 20 is activated (turned ON) by magnetic actuator 16 on tether 23, being in operative proximity to actuation sensing device 18.

Conversely, in FIG. 4*b*, exterior light source 14*a* of carrying container 20 is activated (turned ON) by magnetic actuator 16*a* on tether 23 being in operative proximity to an actuation sensing device 18, whereas interior light source 14*b* of carrying container 20 is de-activated (turned OFF) by the absence of magnetic actuator 16*a* on tether 23.

Figure 5:
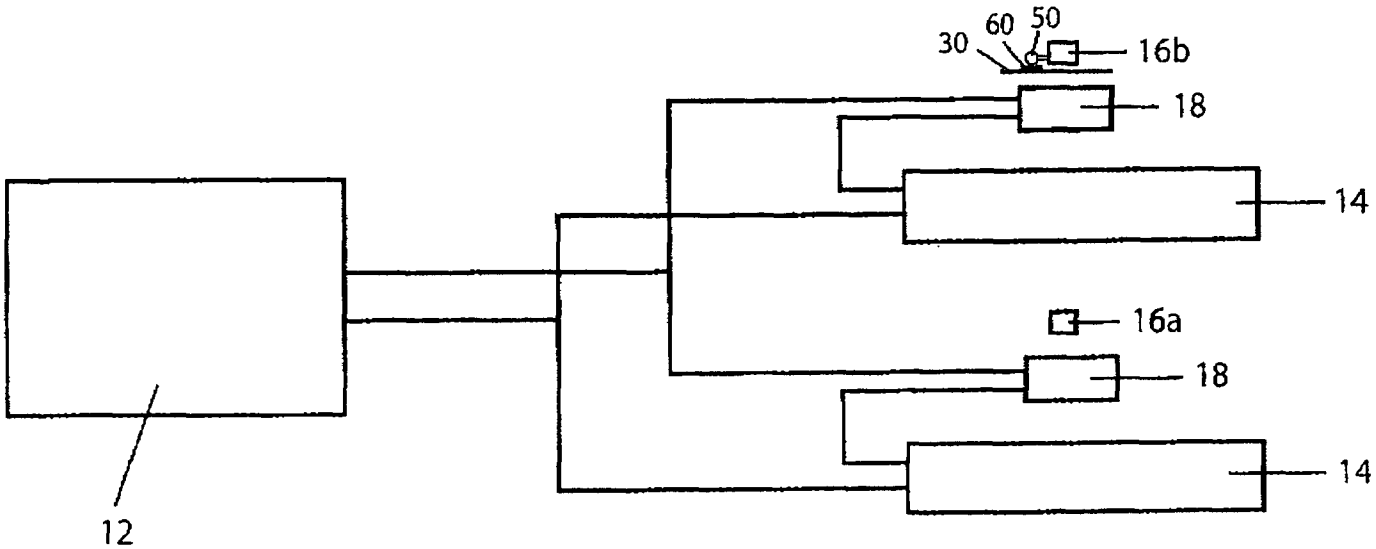
FIG. 5 illustrates a lighting system which can be built into a caning container or optionally coupled to other items where illumination is desired or necessary, comprising two light sources, two actuation sensing devices, two magnetic actuators, each light source and actuation sensing device operatively connected only to one another and to a single power source.

The lighting system as shown in FIG. 5, is comprised of multiple light sources 14, each with an actuation sensing device 18, all operatively connected to a power source 12, one light source operated individually of other light sources within the lighting system by tethered magnetic actuator 16*a*, and second light source operated individually of other light sources within the lighting system by holder 25 with magnetic actuator 16*b*, both light sources 14 activated when magnetic actuators 16*a* and 16*b* are placed in operative proximity to actuation sensing devices 18. Power source 12 can be a rechargeable or non-rechargeable battery.

Figure 6:
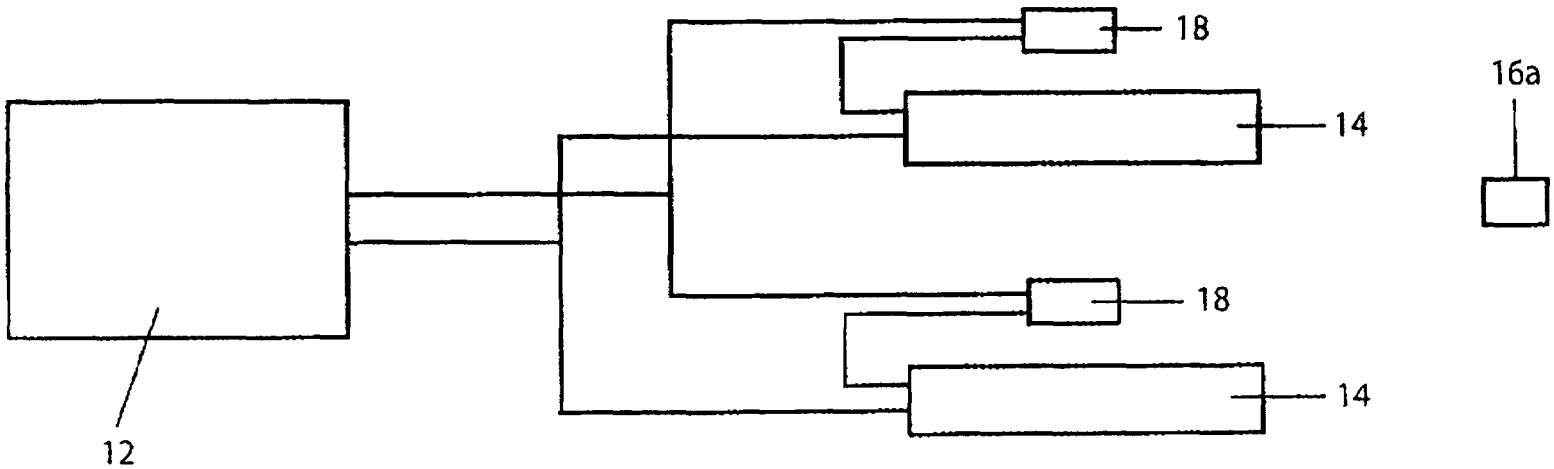
FIG. 6 illustrates a lighting system which can be built into a carrying container or optionally coupled to other items where illumination is desired or necessary; comprising two light sources and two actuation sensing devices, each operatively connected only to one another and to a single power source, all light sources within the system individually activated by a single magnetic actuator.

The lighting system as shown in FIG. 6, is comprised of multiple light sources 14, each with an actuation sensing device 18, all operatively connected to a power source 12, each activated individually of other light sources within the lighting system by a single magnetic actuator 16*a*, placed in operative proximity to any actuation sensing device 18. Power source 12 can be a rechargeable or non-rechargeable battery.

Figure 7:
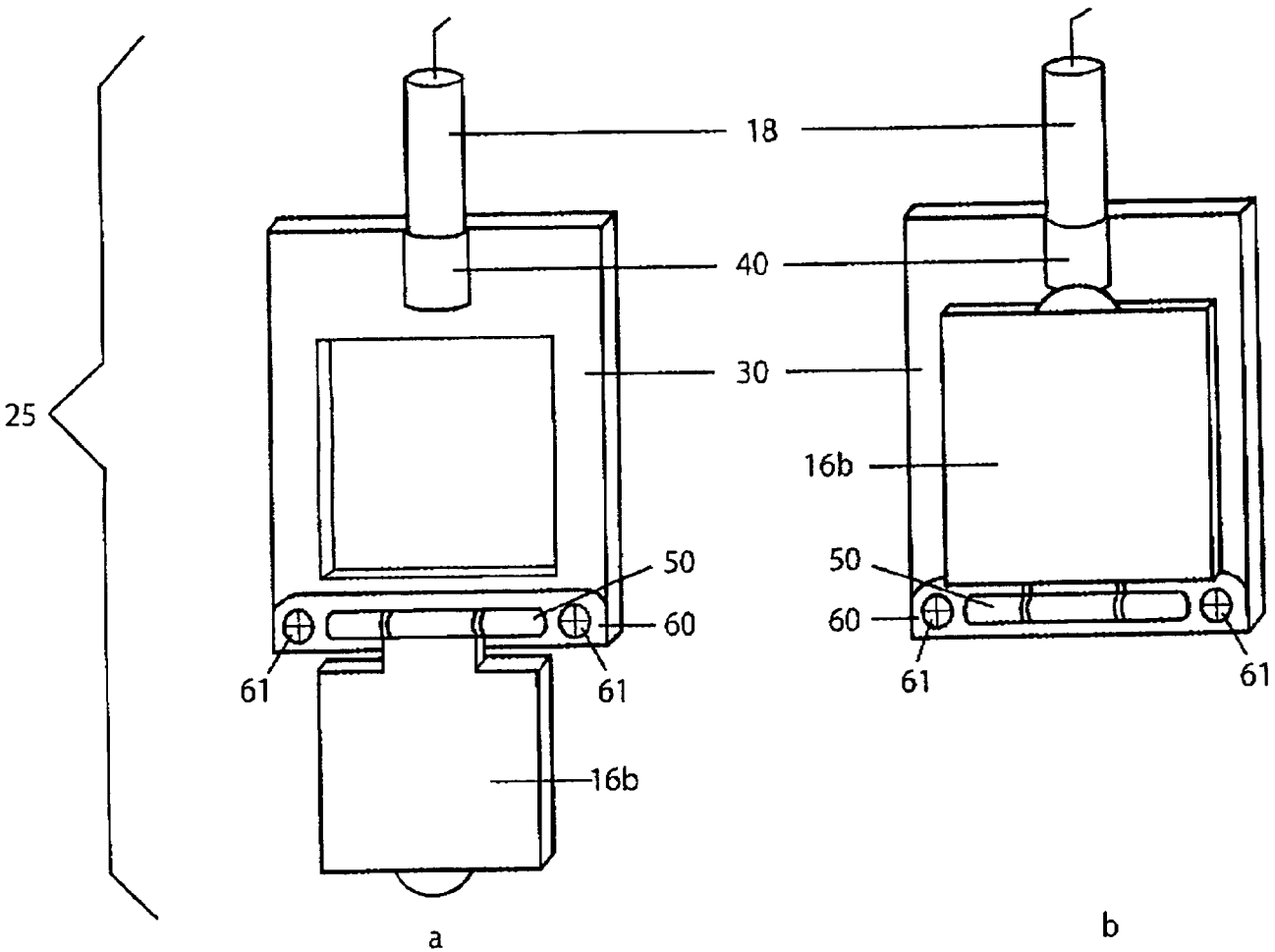
FIG. 7 is an example of a holder for optionally mounting an actuation sensing device and a magnetic actuator to a carrying container.

FIGS. 7*a* and 7*b* is an example of holder 25 for optionally mounting an actuation sensing device and a magnetic actuator to a carrying container, comprised of frame 30 with recess 40 for holding actuation sensing device 18 in place, device 50 with plate 60 for moving affixed magnetic actuator 16*b* from non-operative to operative proximity to an actuation sensing device 18, attachable to frame 30 with screws 61. Frame 30 with recess 40 are mounted to the interior side of a carrying container shell or housing; affixed magnetic actuator 16*b* and device 50 with plate 60, can be mounted interiorly or exteriorly of the carrying container, attachable to frame 30 with screws 61.

In FIG. 7*a* affixed magnetic actuator 16*b* is maintained in non-operative proximity to actuation sensing device 18 by device 50.

In FIG. 7*b* affixed magnetic actuator 16*b* is placed and maintained in operative proximity to actuation sensing device 18 by device 50.

A carrying container can have two shells in the form of a flexible outer surface or housing and an inner flexible shell such as a lining.

Figure 8:
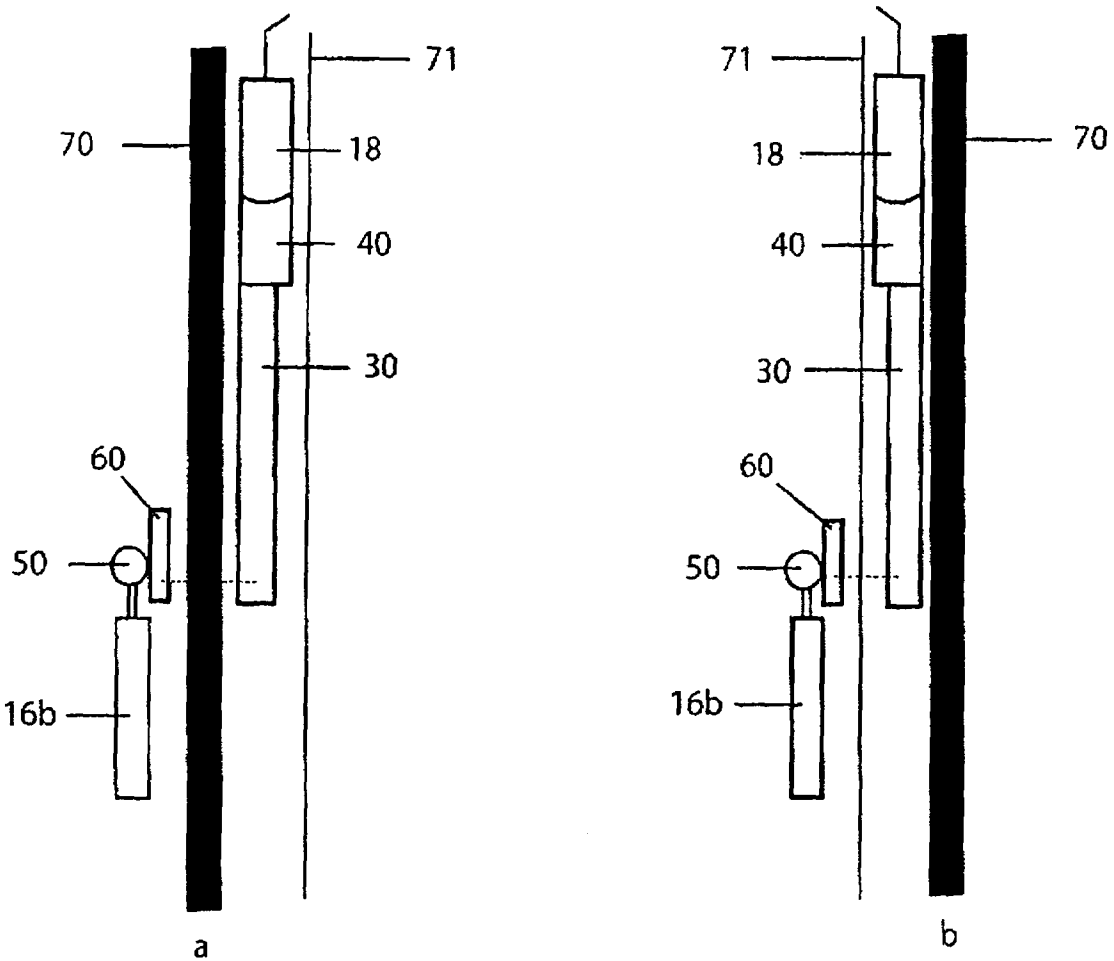
FIG. 8 is an illustration of two ways in which the holder can be mounted to a carrying container.

FIGS. 8*a* and 8*b* is an illustration of two ways in which holder 25, with frame 30 with recess 40 and device 50 with plate 60, can mounted to a carrying container. In both instances, frame 30 is mounted to the interior side of a carrying container flexible outer surface 70, under the flexible inner shell 71. Affixed magnetic actuator 16*b* and device 50 with plate 60, can be mounted interiorly or exteriorly of a carrying container, attached to frame 30 with screws where shown with broken line.

In FIG. 8*a*, frame 30 with recess 40 and device 50 with plate 60, are mounted to the interior side of a carrying container flexible outer surface 70, under the flexible inner shell 71, while affixed magnetic actuator 16*b* and device 50 with plate 60, are mounted to the exterior side of a carrying container flexible outer surface 70, attachable to frame 30 with screws where shown with broken line.

In FIG. 8*b*, frame 30 with recess 40 and device 50 with plate 60, are mounted to the interior side of a carrying container flexible outer surface 70 under flexible inner shell 71, while affixed magnetic actuator 16*b* and device 50 with plate 60, are mounted to the interior side of a carrying container flexible inner shell 71, attachable to frame 30 with screws where shown with broken line.

Carrying containers 10 and 20, in the various embodiments illustrated in FIG. 1-8, provide a secure area for storing a power source 12 in a protective and discreet manner as well as allowing easy replacement or recharging thereof by use of interface 13.

Regardless of the number of light sources, the entire lighting system is powered by a single power source, allowing for significant savings to the overall weight and cost of the lighting system.

Moreover, since each light source can be operated independently of other light sources within and without a carrying container, the power source is not discharged by the unnecessary illumination of all light sources in concert within the lighting system.

The location of the light sources may be on the inside or outside of the carrying container, the bottom, sides, or top of the carrying container, or any combination thereof.

A carrying container with a lighting system comprised of multiple light sources, can have a single, tethered magnetic actuator to activate every light source in and on the carrying container. For ease of use the magnetic actuator tether is long enough to activate any light sources in the lighting system without the user having to untether the magnetic actuator from the carrying container to activate any one of the light sources.

Magnetic actuators can be ornamentally designed to coordinate with the appearance or application of the carrying container.

The actuation holding devices affixed to the exterior and interior of the carrying container can be made of any material desired.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A lighting system comprising:

a. a carrying container including a flexible outer surface defining an interior space and further including a flexible inner shell;

b. a light source including at least one interior light source positioned to illuminate said interior space, and at least one exterior light source positioned to illuminate outside said interior space; said light source being activated individually and at will, independent of the access state said carrying container;

c. a power source configured to energize said light sources;

d. at least one actuation sensing device operatively connected to said light sources and said power source;

e. at least one magnetic actuator;

f. at least first and second magnetic actuator holding devices comprising pockets affixed to said flexible outer surface and interiorly of said carrying container and shaped to receive said at least one magnetic actuator; said first magnetic actuator holding device positioned in operative proximity to said actuation sensing device, and receiving said magnetic actuator to activate said interior or exterior light source when said magnetic actuator is placed and maintained in said actuator holding device; said second magnetic actuator holding device positioned in non-operative proximity to said actuation sensing device and receiving said magnetic actuator when said interior and exterior light sources are de-activated.

2. The lighting system as claimed in claim 1 wherein said interior and exterior light sources are selected from a group consisting of light emitting diodes and electroluminescent panels.

3. The lighting system as claimed in claim 1 wherein said actuation sensing devices are selected from a group consisting of reed switches and magnetic sensors.

4. The lighting system as claimed in claim 1, wherein said power source is a non-rechargeable battery.

5. The lighting system as claimed in claim 1, wherein said magnetic actuator is further defined as being attached to said carrying container by means of a tether.

6. The lighting system as claimed in claim 1, wherein said magnetic actuators and said actuation sensing devices are mounted to said carrying container by means of a holder.

7. The lighting system as claimed in claim 1, wherein said light sources in said lighting system are activated by a single said magnetic actuator.

8. The lighting system as claimed in claim 1, wherein said power source is a rechargeable battery.

9. The power source as claimed in claim 8, wherein said rechargeable battery is further defined as including an interface for recharging said battery from an external source.

* * * * *